United States Patent [19]

Nishikawa

[11] Patent Number: 4,724,025

[45] Date of Patent: Feb. 9, 1988

[54] TRANSFER COATING METHOD

[75] Inventor: Masaji Nishikawa, Tokyo, Japan

[73] Assignee: Olympus Optical Co., Ltd., Tokyo, Japan

[21] Appl. No.: 798,404

[22] Filed: Nov. 15, 1985

[30] Foreign Application Priority Data

Aug. 13, 1984 [JP] Japan ..... 59-169528

[51] Int. Cl.[4] ..... B44C 1/16; B44C 1/17; B05D 3/04; B05D 1/36

[52] U.S. Cl. ..... 156/230; 156/235; 156/249; 427/334; 427/416

[58] Field of Search ..... 156/230, 234, 240, 231, 156/277, 238, 239, 249; 428/914, 195, 327; 427/152, 334, 340, 395, 416, 417, 442, 411; 118/244, 249, 259; 162/158, 164.1, 172

[56] References Cited

U.S. PATENT DOCUMENTS

| | | | |
|---|---|---|---|
| 3,257,226 | 6/1966 | Thwaites | 427/395 |
| 3,628,979 | 12/1971 | Newman et al. | 428/327 |
| 3,895,130 | 7/1975 | Barouh et al. | 427/152 |
| 3,927,226 | 12/1975 | Kadono et al. | 427/416 |
| 3,985,932 | 10/1976 | Porter | 427/416 |
| 4,255,038 | 3/1981 | Simon et al. | 118/259 |
| 4,590,486 | 5/1986 | Yana | 400/120 |
| 4,592,945 | 6/1986 | Mecke et al. | 428/195 |

*Primary Examiner*—Donald E. Czaja
*Assistant Examiner*—Louis Falasco

[57] ABSTRACT

A method of coating an image-recorded surface of printing paper, which surface is formed by attaching a coloring agent to the printing paper in accordance with a recording signal. A coating agent comprising a hot-melt material is supported in the form of a thin film on a surface of a porous support member, and the coating agent in the form of the thin film is brought into contact with the image recorded surface and heated so as to transfer the hot-melt coating agent to the image recorded surface through pores of the support member in an amount corresponding to that used for coating.

1 Claim, 14 Drawing Figures

TRANSFER COATING METHOD

BACKGROUND OF THE INVENTION

The present invention relates to a coating method.

A conventional ink-jet printer selectively discharges small droplets of a liquid ink in accordance with recording signals or controls discharge of such ink droplets so as to form an image.

In a conventional hot-melt transfer printer, a sheet with a hot-melt ink coated thereon and printing paper are superimposed on each other. A recording head comprising a thermal element or a stylus electrode is urged against the back surface of the ink sheet. A recording signal voltage is applied to the recording head to transfer hot-melt ink onto the printing paper.

In a conventional heat-sublimation printer, an ink sheet of a heat-sublimation dye and an image carrier sheet of polyester or the like are superimposed on each other. A thermal head is urged against the back surface of the ink sheet. The heat-sublimation dye is sublimated in accordance with the recording signal and transferred to the image carrier sheet.

Since these printers are of non-impact type, operation noise is small, high-speed printing can be performed, the mechanism is simple, and a color printer can be easily provided. However, images formed by such printers are not free from disadvantages. For example, an image printed by an ink-jet printer cannot have high print density and tends to have relatively poor color clarity. The image also has poor water resistance.

FIGS. 1A and 1B are views for explaining such disadvantages in an ink-jet printer. Referring to FIG. 1A, reference numeral 1 denotes printing paper; 2, a printed image segment; and 3, irregularly reflected light. The paper 1 shown in these figures is slightly uneven. Since the ink slightly covers such paper, the ink layer is also coated in an uneven pattern. Therefore, light is irregularly reflected by the ink layer. Irregularly reflected light lowers the image density and degrades color clarity.

FIG. 1B shows a state wherein a printed image has been partially wetted with water. Referring to FIG. 1B, reference numeral 2 denotes a printed image segment; and 4, a water droplet. When the water droplet 4 becomes attached to the image, the dye dissolves and causes damage to the image.

An image formed by a hot-melt transfer printer is subject to the problem of degradation in image quality due to deformation of image dots by an external force such as rubbing. FIG. 1C is an enlarged sectional view of such an image. Referring to FIG. 1C, reference numeral 5 denotes printing paper; 6, a hot-melt ink image; 7, a printed image segment subjected to an external force; and 8, a printed image segment enlarged due to deformation by the external force. FIG. 1D is a plan view of the image shown in FIG. 1C. In FIG. 1D, reference numeral 9 denotes an arrow that indicates the direction along which the image surface has been rubbed. The rubbed image segment 8 is blurred from a pixel end and the image area is increased. Thus, the rubbed segment 8 has a higher print density than the remaining image segment and is therefore enhanced.

Back transfer occurs when a sheet of paper is placed on an image formed by the hot-melt thermal printer and one writes on this sheet of paper. The hot-melt ink is transferred to the paper's back surface.

Ink dye used in a heat-sublimation printer is basically unstable in the presence of heat and may cause discoloration of an image over time. In order to prevent this, dye having a high sublimation temperature must be used. However, in this case, excessive thermal stress is put on a recording head, and the life of the head is shortened. In addition, since the current capacity of the head drive circuit is increased, the overall drive circuit, including a power source, is rendered large in size. When the sublimation temperature of the dye is decreased in view of such problems, the stability of printed images is significantly degraded.

As described above, printers of various types for forming images by selectively applying a colorant on printing paper can provide only unsatisfactory image stability and density. The stated disadvantages have prevented these printers from being commercially worked.

Some countermeasures have been proposed in view of these problems. For example, Japanese Patent Disclosure No. 59-39575 discloses an apparatus which has a laminater for laminate coating the image-carrying surface of a printing paper sheet with a transparent film sheet. However, a material which can form a film by lamination is limited to a film-forming material. Therefore, the surface of printing paper laminated with such a film has a surface state very different from a normal paper surface. In addition, no further writing can be done on the laminated surface. The printing paper must be sufficiently dried before lamination, the lamination apparatus is hard to design, and the field for application of such an apparatus is limited.

Japanese Patent Publication No. 56-2022 discloses a printer wherein an ink droplet path from an ink-jet nozzle to printing paper is filled with the mist of a glossy liquid. The gloss of the paper is thereby improved without causing clogging of the ink-jet nozzle. However, it is difficult to form a stable mist in air without dispersion and to maintain it at a level capable of improving gloss.

In a technique disclosed in Japanese Patent Publication No. 56-26312, an image is formed by a heat ray-absorbing ink. The image is irradiated with heat rays to heat only the image portion. Image ink heated to a high temperature in this way is brought into contact with a coating agent so as to selectively coat the image portion. However, in this method, heat is easily diffused from the image ink and the heated image portion is easily cooled. Since the heat capacity of the image ink is very low, it is almost impossible to melt the coating agent and it is assessed to be very difficult to put a stable coating operation into practice.

SUMMARY OF THE INVENTION

It is an object of the present invention to provide a coating method for easily forming a coating layer on a printed image formed by selectively coating a coloring agent on printing paper.

In order to achieve the above object of the present invention, after a coloring agent is selectively coated on an image on printing paper recorded in accordance with a recording signal, a transparent hot-melt coating agent is supported in the form of a thin film, and is brought into contact with the surface of the recorded image while heat is applied. Thus, the hot-melt coating agent is transferred onto the recorded image. According to the present invention, control of the melt/solid state of the coating agent can be performed by simply heating- /cooling the agent. In addition, the coating agent in a thin film form is uniformly hot-melted and transferred to printing paper. Therefore, the coating apparatus can have a very simple structure and can be integrally included in a printer, as needed. Since the coating agent does not contain a solvent, the method of the present invention is free from coating condition changes or storage life changes due to composition change.

DETAILED DESCRIPTION OF THE PREFERRED EMBODIMENTS

Figure 2:
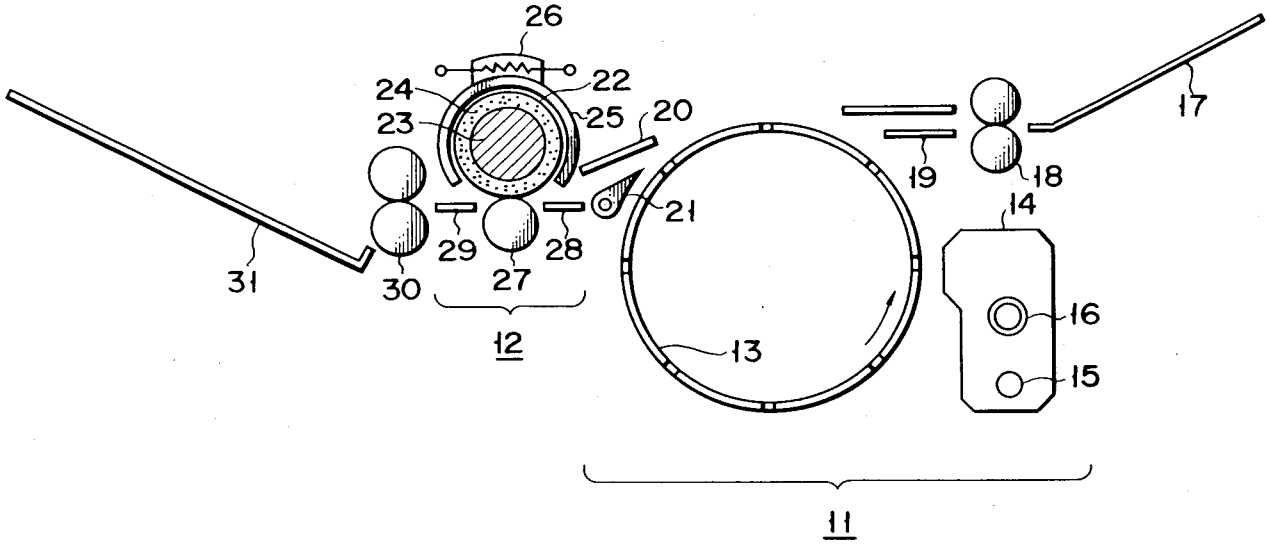
FIG. 2 is a diagram showing an apparatus for performing a coating method according to an embodiment of the present invention.

FIG. 2 shows a hot-melt coating apparatus for a method according to an embodiment of the present invention. In FIG. 2, immediately after an image is formed by an ink-jet printer, a transparent hot-melt coating agent is coated by the hot-melt coating apparatus arranged in the printer. Referring to FIG. 2, reference numeral 11 denotes an image printer; and 12, a hot-melt coating apparatus. A vacuum suction drum 13 keeps the drum interior at a negative pressure by a suction means (not shown) so as to hold printing paper on the drum surface. Reference numeral 14 denotes an ink-jet printer head; 15, a feed guide rail; and 16, a feed screw. The drum 13 is rotated in a direction indicated by an arrow. A band-like scanning region for recording is formed along the circumferential direction of the drum 13. The head 14 is moved along the rotating axis of the drum 13 by the feed screw 16 so as to scan the entire surface of the drum. Reference numeral 17 denotes a printing paper Insertion tray; 18, a pair of supply rollers; and 19, guide plates.

Printing is performed in the monochromatic mode with black ink or in the color mode with cyan, magenta, and yellow inks. Printed paper is peeled from the drum 13 by a peeling pawl 21 and is fed to the coating apparatus 12. The apparatus 12 includes a coating roller 22, a pressure roller 27, and a heating cover 25. The coating roller 22 is obtained by filling a hollow roller 24 of porous material with a hot-melt coating agent 23. The heating cover 25 has a heater 26 and heats the coating roller 22 to an appropriate temperature for melting the coating agent 23.

The coating agent used in the method of the present invention is selected from materials which are solid at ambient temperature, form a thin film upon being melted by heating and do not have color which interfere with normal printing.

Preferred examples of coating agents may include a wax such as polyethylene glycol, carnauba wax, paraffin or chlorinated parraffin; an aliphatic acid such as capric acid, lauric acid, stearic acid, palmitic acid, behenic acid or oleic acid; a stearic acid metal salt such as zinc stearate; and an aliphatic acid metal salt such as oleic acid metal salt, palmitic acid metal salt, or linoleic acid metal salt.

The coating roller 22 comprises a porous structure which consists of a porous ceramic roller or a metal roller having a number of pores on its surface, and a fibrous or metal mesh layer formed on such a ceramic or metal roller. The heater 26 for heating the heating cover 25 can conveniently comprise a heating element which is self-controlled in order to obtain a constant temperature by increasing resistance as the temperature increases. The heater 26 may comprise, instead, a control system which is regulated by the output from a temperature sensor.

When the coating roller 22 is heated, the coating agent 23 in the roller 22 spreads out and forms a thin film on the roller surface. The film is in a melted state.

When printed paper is supplied, the coating roller 22 is brought into contact with a printed image and the coating agent 23 is uniformly coated thereover. The coated paper is expelled onto a tray 31 by a roller pair 30. During this time, the coating agent 23 has cooled and solidified to form a coating layer covering the paper surface. During the coating operation, another thin film of the coating agent 23 is formed through the pores of the coating roller 22 so as to allow continuous coating.

A coating effect of the coating agent 23 will be described with reference to FIG. 3. In this example, paraffin is used as the coating agent.

Figure 3A:
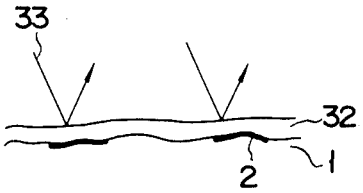
FIGS. 3A to 3F are views for explaining effects obtained with the method of the present invention.

FIG. 3A is an enlarged model diagram for explaining an effect obtained when a hot-melt coating of a thin paraffin film is coated on the surface of an image formed by an ink-jet printer. Referring to FIG. 3A, reference numeral 1 denotes printing paper; 2, image ink; 32, a paraffin layer; and 33, surface reflected light. The paper surface is uneven. When such a paper surface is covered with paraffin, the surface exposed to the air is smooth and in itself causes little irregular reflection. Since the surface with the printed image is covered with paraffin, almost no additional reflection occurs. Thus, the coated paper surface causes little irregular reflection, image density is increased, and excellent color clarity is obtained.

Figure 3B:
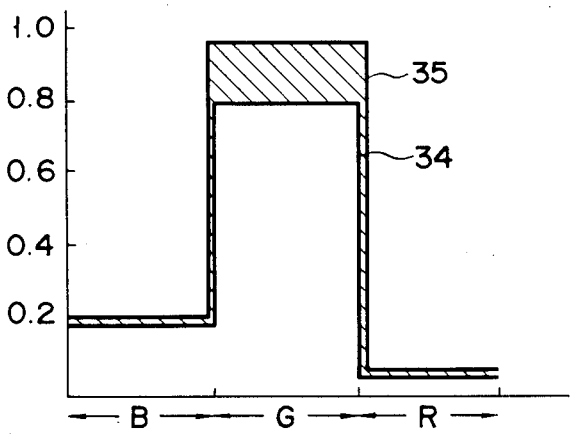
Figure 3C:
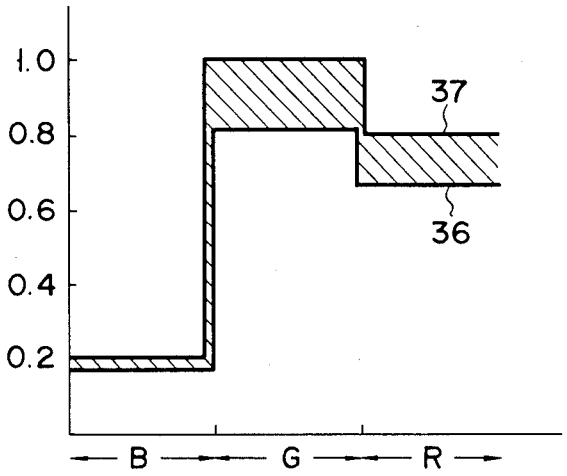
Figure 3D:
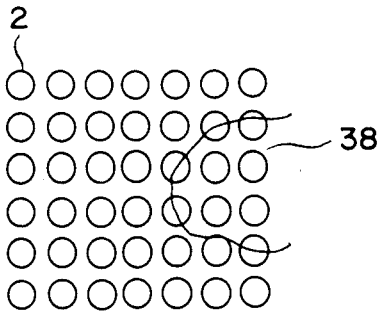

FIGS. 3B and 3C show density data. The data was obtained in the following manner. A rectangular image was formed on high-quality paper by an ink-jet printer, and the image was partially coated with melted paraffin. Coated and uncoated image surfaces were measured for their densities by a density meter. Measurement was made with a reflection-type density meter "MODEL RD-914", available from Macbeth, Inc. A graph for the reflection density data was obtained by passing reflected light through R, G, and B filters of the density meter. The graph does not therefore represent a measurement value of a spectral reflectance. FIG. 3B in particular shows a graph for reflection density data for a red image segment. A line 34 corresponds to an uncoated surface, and a line 35 corresponds to a coated surface. As compared with the uncoated surface 34, the coated surface 35 has higher density overall. Such an increase in density is particularly notable in portion which has been measured through a green filter and has high density. This is attributed to the fact that the effect of reduced surface reflection upon temperature increase is larger a high-density portion in which the absolute amount of reflected light is small. Visual observation of the coated and uncoated surfaces revealed that the coated surface had the higher density and better color clarity.

FIG. 3C shows data on an image segment printed in purplish blue. It is seen from FIG. 3C that density is increased by coating green and red segments in which density is already high. Visual observation of coated and uncoated surfaces also revealed that density was increased and better color clarity was obtained in the coated surface.

In this manner, the color clarity of an image subject to the problem of irregular surface reflection, such as an image formed by an ink-jet printer, can be improved by the use of a hot-melt coating agent. The coating method of the present invention can be effectively used for such purposes.

A water resistance test was performed on a coated image surface produced by a coating methods of the present invention. In the test, a water droplet, indicated by reference numeral 38 in FIG. 3D, was placed on an image sample formed by an ink-jet printer and coated in the manner as described above. The droplet was repelled and the ink did not dissolve. It was thus confirmed that the coating method of the present invention can also improve the water resistance of recorded images.

The printer 11 in FIG. 2 is an ink-jet printer. However, an image to be coated by the method of the present invention is not limited to images formed by an ink-jet printer and can be applied to images formed by a hot-melt transfer printer or a heat-sublimation printer. In this case, the construction of the printer 11 is replaced with a suitable construction.

Figure 1A:
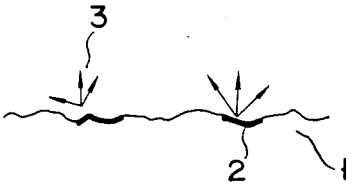
FIG. 1A (PRIOR ART)
FIGS. 1A to 1D are views showing problems of the prior art.
Figure 1B:
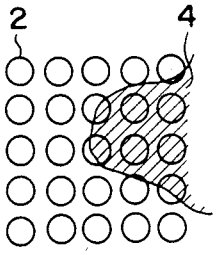
FIG. 1B (PRIOR ART)
Figure 1C:
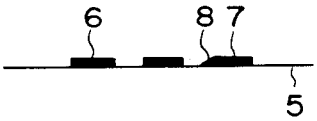
FIG. 1C (PRIOR ART)
Figure 1D:
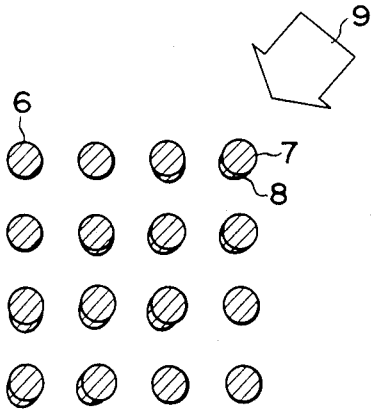
FIG. 1D (PRIOR ART)
Figure 3E:
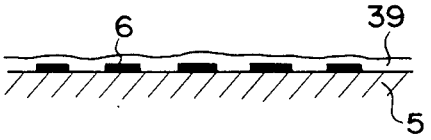
Figure 3F:
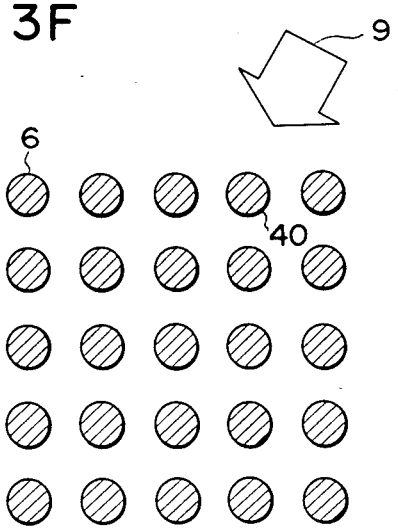

FIGS. 3E and 3F show an effect obtained when the method of the present invention is applied to a hot-melt transfer image and a hot-melt coating agent is used. FIG. 3E shows a sectional view of printing paper after coating. Referring to FIG. 3E, reference numeral 5 denotes printing paper; 6, a hot-melt transfer image; and 39, a coating layer. When such a coating treatment is used, the transfer image 6 is surrounded by the coating agent and is not easily deformed upon application of an external force. FIG. 3F shows a diagram wherein a coated image surface 40 is rubbed with a fingernail in a direction indicated by arrow 9. As shown in FIG. 1D, when coating is not performed, the pixel dot is blurred and enlarged to form a high-density streak. However, in FIG. 3F, such a change in the image segment is not observed. It is therefore demonstrated that coating is effective in protecting a printed image against external forces and such coating can be effectively performed by the method of the present invention.

The effects of the present invention have been described with reference to cases of ink-jet and hot-melt transfer images. However, it is apparent that the method of the present invention can provide the same effect when applied to images formed by other methods. For example, when the coating method of the present invention is applied to a heat-sublimation image, sublimation of the dye during storage of printed images and resultant discoloration of the images can be prevented. Therefore, a dye having a low sublimation temperature can be used as a coloring agent. In addition, since recording energy to be applied to the recording head can be reduced, the head drive power source and other circuit portions can be simplified. Thermal stress on the recording head is reduced, and the head life is prolonged. Also, since the head is driven at a relatively low temperature, high-speed recording can be performed. The method of the present invention is very effective in coating a printed image.

In the method of the present invention, a hot-melt coating agent is held in the form of a thin film. The thin film is brought into contact with a printed image surface and is heated to melting point. The coating agent is transferred to the image surface. The method of the present invention can be achieved in various different manners.

Figure 4:
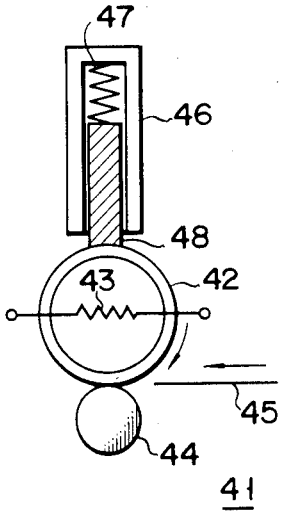
FIGS. 4 to 6 are diagrams showing another apparatus for performing a coating method according to the present invention.

FIG. 4 shows an apparatus for performing a method according to another embodiment of the present invention. FIG. 4 illustrates only a coating apparatus 41. Referring to FIG. 4, reference numeral 42 denotes a coating roller; 43, a heater; 44, a pressure roller; 45, printed paper; 46, a coating agent holder; 47, a spring; and 48, a hot-melt coating agent. The coating roller 42 is heated to a predetermined temperature by the heater 43 so as to melt the coating agent 48. The coating agent 48 is held in the holder 46 and is biased by the spring 47 toward the coating roller 42. Since the coating roller 42 is heated to the softening/melting temperature of the coating agent 48, the portion of the coating agent 48 in contact with the coating roller 42 is gradually melted onto the roller and forms a thin film thereon. When the printed paper 45 passes the nip portion between the pressure roller 44 and the coating roller 42, a layer of the melted coating agent 48 is transferred onto the surface of the printed paper 45.

In order to maintain the supplied amount of the coating agent 48 constant, the temperature of the coating roller 42 must be controlled with high precision. In order to regulate the temperature settings and to achieve a stable coating agent supply, a mechanism for maintaining the supply speed of the coating agent 48 at a constant value by means of a feed screw or the like can be used.

As compared to the apparatus shown in FIG. 2, the apparatus shown in FIG. 4 has a simpler construction of the coating roller, and allows easier replenishment of the coating agent and easier control over the supplied amount of the coating agent.

Figure 5:
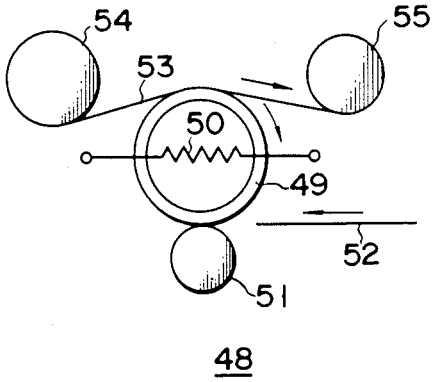

FIG. 5 shows an apparatus for performing a method according to still another embodiment of the present invention. In the apparatus shown in FIG. 5, the handling of the coating agent is simplfied, and the coating agent supply control mechanism is simplfied and stabilized. Referring to FIG. 5, reference numeral 49 denotes a coating roller; 50, a heater; 51, a pressure roller; 52, printed paper; 53, a coating agent coating sheet; 54, a sheet supply roller; and 55, a sheet take-up roller.

The coating roller 50 is heated to a temperature slightly exceeding the hot-melting temperature of a coating agent and is rotated in the direction indicated by an arrow. The coating agent coating sheet 53 is obtained by coating a surface of a paper or plastic sheet with the coating agent. When the paper 52 and the sheet 53 are moved at similar speeds, the thickness of the coating agent on the coating sheet 53 is set to be substantially equal to that of the coating layer to be formed on the printing paper 52. When the speed of the coating sheet 53 is set to be l/n that of the printed paper 52 and the thickness of the coating layer formed on the sheet 53 is set to be about n times the thickness of the coating layer formed on the printing paper, the coating agent supply capacity of the sheet supply roller 54 can be improved and replacement frequency of the roller 54 can be decreased.

The coating rollers shown in FIGS. 4 and 5 preferably have some surface unevenness so that the coating agent can be evenly held on the roller surfaces and uniformly applied.

In the embodiments shown in FIGS. 4 and 5, a support member for supporting the coating agent in a thin layer form comprises an endless rotating member. A station for supplying the coating agent abuts the rotating path of the support member. While coating is performed, the coating agent is simultaneously replenished. Replenishment of the coating agent is thus made easy.

Figure 6:
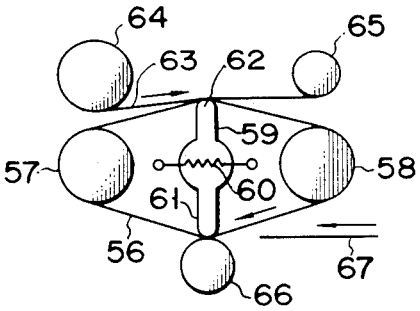

In the embodiments shown in FIGS. 2 to 5, a coating agent is supported on the surface of a roller support member in the form of a thin film layer. However, the shape of the support member can be changed as needed. FIG. 6 shows an embodiment wherein a belt-like support member is used, a coating agent replenishment station is arranged on a portion of the circulation path of the support member, and a separate coating station is provided.

Referring to FIG. 6, reference numeral 56 denotes a coating agent support member; 57 and 58, drive rollers; 59, a heater assembly valve; 60, a heater; and 61 and 62, ends. These parts are arranged on the inner side of the belt convey path 56 and support the belt. Reference numeral 63 denotes a coating agent coating sheet; 64, a supply roller; 65, a take-up roller; 66, a pressure roller; and 67, printed paper. The belt 56 is heated where it comes into contact with the ends 61 and 62 of the assembly valve 59. At the end 62, the coating agent is supplied onto the belt 56, and at the end 61, the coating agent is coated on the printed paper 62. The endless belt can be easily manufactured by electroforming, and a belt having good thermal conductivity, such as a nickel belt having a thickness of several tens to several hundreds of microns, is preferably used. The belt also has an uneven surface.

When the coating layer is held in a thin film form by the sheet-like member as shown in FIG. 6, the sheet is heated in a linear region elongated along the width-wise direction of the printing paper at the coating station. The printed paper and the sheet move toward the heating means while a two-dimensional coating region is formed. Since the heating region is not excessively large, heat utilization efficiency is improved and temperature increase in the apparatus can be prevented.

As has been described with reference to the embodiments, according to the coating method of the present invention, a hot-melt coating agent is used and is held in a thin film form. As compared to a method using a coating agent containing a solvent, handling of the coating agent is easy, properties of the coating agent are more stabilized, and control of the coating process can be easily performed with the use of heat.

What is claimed is:

1. A method of coating an image-recorded surface of printing paper, which surface is formed by attaching a coloring agent to the printing paper, in accordance with a recording signal, comprising the steps of:

supporting a transparent coating agent made of a hot-melt material, in the form of a thin film, on a sheet-like member to oppose the image recorded surface;

forming a linear heating region elongated in a width-wise direction of the printing paper;

forming a two-dimensional coating region by moving the printing paper and the sheet-like member towards the heating region; and bringing the coating agent, which is in the form of the thin film, into contact with the image-recording surface, while heating the coating agent, thereby transferring the hot-melt coating agent onto the image-recorded surface.

* * * * *

UNITED STATES PATENT AND TRADEMARK OFFICE

CERTIFICATE OF CORRECTION

PATENT NO. : 4,724,025

DATED : Feb. 9, 1988

INVENTOR(S) : Masaji Nishikawa

It is certified that error appears in the above-identified patent and that said Letters Patent are hereby corrected as shown below:

ON THE TITLE PAGE:

Item [30] to be deleted.

Signed and Sealed this

Sixteenth Day of August, 1988

*Attest:*

DONALD J. QUIGG

*Attesting Officer*

*Commissioner of Patents and Trademarks*